United States Patent [19]

Wojtysiak

[11] Patent Number: 4,928,743

[45] Date of Patent: May 29, 1990

[54] SINGLE ROD AND LOCK BRACKET SOFT SHADE SYSTEM, KIT AND METHOD

[76] Inventor: Pamela Wojtysiak, P.O. Box 224, St. John, Ind. 46373

[21] Appl. No.: 348,408

[22] Filed: May 8, 1989

[51] Int. Cl.[5] ..... A47H 13/14

[52] U.S. Cl. ..... 160/84.1; 160/330; 160/385

[58] Field of Search ..... 160/84.1, 330, 340, 160/348, 388, 385

[56] References Cited

U.S. PATENT DOCUMENTS

| | | | |
|---|---|---|---|
| 2,115,796 | 5/1938 | Bradfield, Jr. | 156/17 |
| 2,256,359 | 9/1941 | Stark | 156/17 |
| 3,528,477 | 9/1970 | Abraham | 160/84 |
| 3,593,772 | 7/1971 | Abraham | 160/84 |
| 3,777,800 | 12/1973 | Susoev | 160/84 R |
| 3,952,788 | 4/1976 | Scholer | 160/84 R |
| 4,088,170 | 5/1978 | Franklin | 160/84 R |
| 4,245,688 | 1/1981 | Vecchiarelli | 160/178 C |
| 4,501,311 | 2/1985 | Folland | 160/127 |
| 4,739,815 | 4/1988 | Altman | 160/84.1 |
| 4,825,611 | 5/1989 | Bassett | 160/84.1 X |

FOREIGN PATENT DOCUMENTS

| | | | |
|---|---|---|---|
| 199330 | 2/1958 | Austria | 160/388 |

OTHER PUBLICATIONS

American Swish Components for Austrian, Roman, and Festoon Shade Track, p. 1 of OB/MASCO American Swish 1986 Dealer Price List.

Balloon shade kits, p. 39 of Graber catalog.

Roman Systems Inc. flyer re: soft shades.

*Primary Examiner*—Blair M. Johnson

*Attorney, Agent, or Firm*—Richard G. Kinney

[57] ABSTRACT

A kit for constructing a raisable soft curtain mounted on a single conventional U-shaped curtain rod including a plurality of tough mesh loops which can hook onto the horn of a conventional U-shaped curtain rod's wall bracket. The loops have master rings or guides for pull cords. The kit also includes means for vertically mounting a series of cord guides or rings to a sheet of curtain fabric. Further included is a replacement combination rod mounting bracket and manually releasable cord latch or lock mechanism. Sufficient cord is also provided for running from the bottommost ring in each vertical series of rings, through that series of rings and through the master ring to the latch or lock mechanism and down one side of the installed curtain. A curtain is constructed by (a) securing the series of rings to a sheet of curtain fabric, (b) securing the loops and master rings at the top by folding over the margin of the fabric sheet and sewing the loops into or onto the curtain rod pocket, (c) tying the cord to the bottom and running it through the rings, and (d) installing and hanging the curtain from a rod using the combination latch at one end with the cords from each vertical series of passing through the master ring of a loop through to the latch and down the sides of the curtain, such that the loops, master rings serve to carry and transfer the weight and forces involved in raising the curtain to the curtain rod and its mounting bracket.

11 Claims, 3 Drawing Sheets

SINGLE ROD AND LOCK BRACKET SOFT SHADE SYSTEM, KIT AND METHOD

FIELD OF THE INVENTION

The present invention is directed toward a new and improved system, kit and method for making a soft shade (such as a Balloon Curtain, Austrian, Roman, Cloud, Smocked or Deco Fold shade) and is particularly concerned with the mounting of the shade to its rod and the raising hardware and bracket for the cords used in raising such soft shades.

BACKGROUND OF THE INVENTION

Soft shades of various general types are known. These include Austrian, Balloon, Pleated Balloon, Roman, Cloud, Smocked and Deco Fold shades. Prior art soft shade systems either employ multiple rods, special head or rod arrangements and/or complicated construction and installation. Prior art raisable soft curtains often require four or more spaced-apart mountings to the wall or window frame. Complicated construction of such shades often precludes the average homemaker from making a soft shade at home. Some of the soft shades sold for home assembly employ temporary expedients, such as velcro hook and loop fasteners, which must be glued to a rod and must be replaced over time, especially after cleaning or washing the shade.

Examples of prior proposed soft shade systems include those described in U.S. Pat. Nos. 3,593,772, 3,528,477 and 4,501,311, which require special heading provisions. U.S. Pat. No. 3,952,788, which discloses another curtain system, is complicated and not suitable for home construction. U.S. Pat. No. 4,739,815, while perhaps capable of easy construction, suffers from drawbacks in that its lock or latch for its pull cords may not be easily used by a short person or on a tall window and that it requires relatively strong fabric for its curtain to resist stresses in raising and holding up the curtain, and suffers from the requirement that it uses hook and loop fasteners to prevent lateral shifting of its curtain during rising.

Other U.S. patents of possible interest include U.S. Pat. Nos. 3,777,800 and 4,245,688.

There exists a need in this art for an easily made raisable soft curtain which may be used with many different types of curtain fabric without unduly stretching or tearing them and which is easy to make and is easy to to mount on, for example, the conventional curtain rod.

SUMMARY OF THE INVENTION

The present invention provides a kit for a conventional curtain rod and for turning nearly any sheet of fabric of a suitable size into a raisable soft curtain. The kit includes a plurality of strong flexible strap loops for fitting over the curtain rod at its ends and at spaced positions along its length. The loops support main rings or guides for pull cords which in the assembled curtain serve to transfer the weight and force from the cords to the loops to the rod and its support. A set of guide rings are provided, one for each main loop, for securing vertically to the back of the fabric, and sufficient cordage is provided for running from the bottom of each vertical series through the main rings and to one of the curtain rod ends and downward to serve as a pull. Finally, a unique replacement curtain rod bracket is supplied which combines a cord latch or lock and curtain rod receiver.

A major feature of the present invention is the use of nylon or like strong flexible mesh material for the loops with a mesh sized so as to be captivated by the horn of the conventional curtain rod mounting bracket. This secures the side loops in place to the brackets and thus secures the completed curtain in place and prevents or lessens sideways movement of the curtain rod pocket as well as transfers some forces directly to the rod bracket.

Other features of the invention will become clear from the following description and claims.

The invention, together with the advantages thereof, may best be understood by reference to the following description taken in connection with the accompanying drawings, in the several figures of which, like reference numerals identify like elements.

DETAILED DESCRIPTION OF PREFERRED EMBODIMENTS

Figure 1:
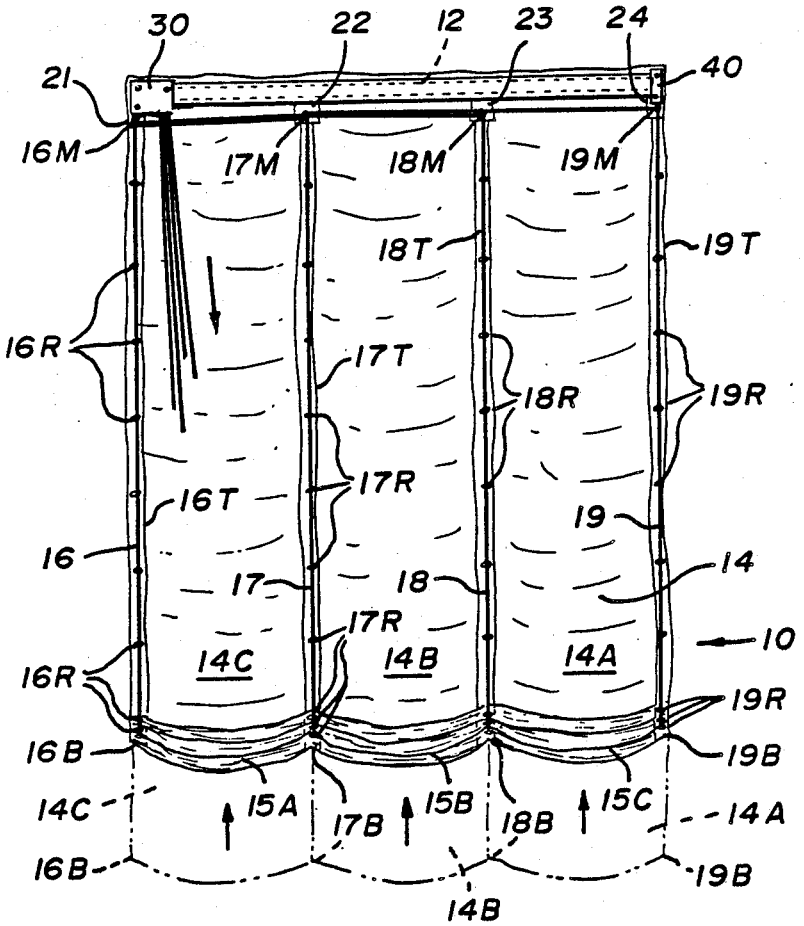
FIG. 1 is an elevational view of the back or window-side of a raisable soft curtain system constructed in accordance with the present invention with a moved position of a portion of the curtain shown in phantom outline and an internal part (the standard curtain rod) shown dashed.

Referring now to the figures and especially FIG. 1, there is depicted a raisable soft shade system constructed in accordance with the principles of the present invention and generally designated by the number 10.

The soft shade system 10 is mounted on a conventional or standard U-shaped tubular curtain rod 12 shown in dashed outline. Only one curtain rod 12 is needed for the system 10. The rod 12 is supported at its ends by brackets 30 and 40 which are in turn secured to the wall (not shown). The depicted example of the invention is a balloon shade having a generally rectangular fabric sheet 14 divided into three vertical sections 14A, 14B and 14C so as to hang and raise in three decorative lobes 15A, 15B and 15C as it is raised upward from its fully extended or down position which is shown in phantom outline in FIG. 1.

As is conventional for such a soft shade, the shade 10 is raised by means of pull cords 16, 17, 18 and 19 which are tied or otherwise secured to the bottom of the sheet 14, at 16B, 17B, 18B and 19B.

A series of spaced-apart guide rings 16R, 17R, 18R and 19R are secured to the back of the sheet 14 in vertical arrays. The guide rings 16R–19R secure the pull cords 16–19. All such rings are made of non-metallic material such as plastic.

The guide rings 16R–19R are preferably secured to the sheet 14 by first securing or sewing them onto a length of tape 16T, 17T, 18T and 19T and then sewing the tape to the back of the sheet 14.

Figure 2A:
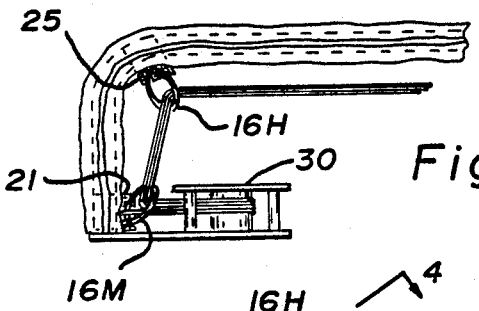
FIG. 2A is a detailed top view on an enlarged scale of the left end of the system of FIGS. 1 and 2.
Figure 2:
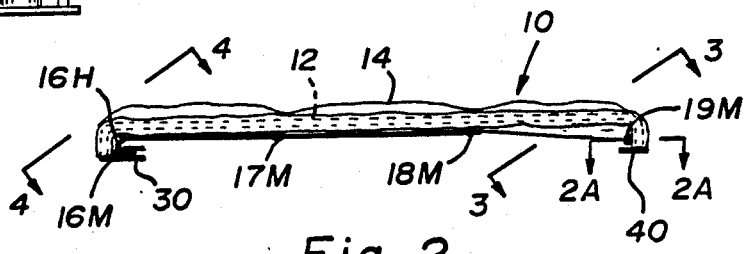
FIG. 2 is a top view of the curtain system of FIG. 1 with an internal part, the standard U-shaped curtain rod, shown dashed.
Figure 7:
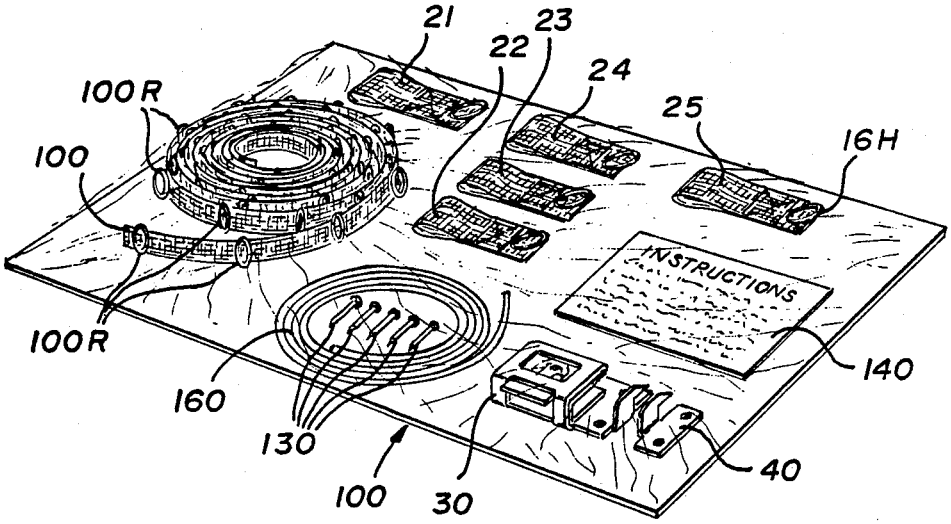
FIG. 7 is a perspective view of a package of a kit for forming the raisable soft curtain system of the present invention.

In accordance with a major feature of the present invention, a set of four tape or strip loops 21, 22, 23 and 24 are provided. These loops 21–24 are each made of strong mesh material, preferably nylon, and serve to mount the main or top guide rings 16M, 17M, 18M and 19M. These loops are preferably formed of a length of mesh tape folded over so as to overlay itself which is sewn together at the overlay portion (FIGS. 3 and 4) and extends below to position the main rings 16M–19M perhaps one inch below the top of the loop. An optional helper ring 16H is also provided secured to the fabric of the curtain or to its own loop 25 as shown in FIGS. 2A and 7. This optional loop 25 and ring 16H may be used when it is desired to keep the horizontal cords close to the curtain rod.

The placing of the top rings 16M–19M and 16H on the loops 21–25 means that all of the forces exerted on the main rings by pulling on the pull cords 16–19 are transferred through those rings 16M–19M and 16H to the loops 21–25 and thus to the curtain rod 12 and its 30 and 40. This means that no significant forces are exerted directly on the fabric of the sheet 14. Thus, the danger of that sheet tearing is eliminated or materially lessened. Further, the weight of the raised sections 15A, 15B and 15C which is carried by the pull cords 16, 17, 18 and 19 is transferred to the main rings and through them to the rod 12 and brackets 30 and 40.

Figure 3:
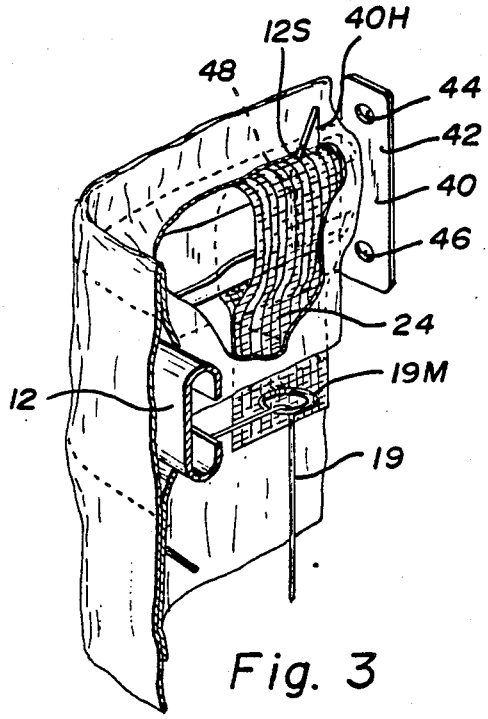
FIG. 3 is a perspective view of a portion of the system of FIGS. 1 and 2, as seen approximately from line 3—3 in FIG. 2; and shown partly in section with parts broken away to show internal parts, and with internal parts shown in dashed outline.

The bracket 40 as shown best in FIG. 3 is preferably an entirely conventional curtain rod bracket having a wall plate 42 secured by screws or nails through holes 44, 46 to a wall or window frame. Projecting outward from the wall plate 42 is a generally planar hook member 48 which has a top horn 40H. As is conventional, the member 48 is seated snugly within the end of the curtain rod 12 with the horn 40H projecting through the conventional slot 12S of the rod 12.

In accordance with the present invention, the loop 24 has its mesh pressed over the horn 40H so as to anchor the loop 24 in place. That is, the taut mesh material of the top of the loop 24 has a mesh opening sized large enough to receive and surround the point of the horn 40H. This means that the lateral forces of the pull cord 16 when pulled do not cause the loop nor the left edge of the curtain 14 to slide down the rod 12, as can occur with some other curtain constructions.

Figure 3A:
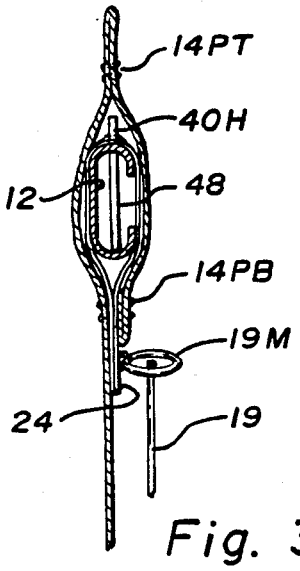
FIG. 3A is a sectional view from the line 2A—2A in FIG. 2.

As best shown in FIG. 3A, the loop 24 is secured to the fabric by being sewn inside the curtain rod pocket formed by folding back the fabric 14 over onto itself and sewing it along the lines 14PT and 14PB. The same sewing 14PB that forms the pocket also secures the loop 24 in place.

Figure 4:
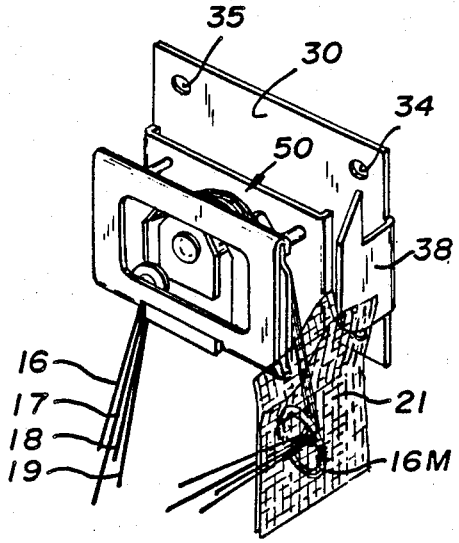
FIG. 4 is a perspective view of another part of the system, a combination cord lock or latch and rod support bracket, as seen approximately from the line 4—4 of FIG. 2, with parts removed for clarity.

As best shown in FIG. 4, the bracket 30 is, in accordance with the present invention, constructed to serve both as a latch or lock for the cords 16–19 as well as to provide a more or less conventional hook and horn structure 38 with a horn 38H for receiving the opposite end of the rod 12. (For clarity, the rod 12 is not shown in FIG. 4.) (The horn 38H also serves to anchor the loop 21, although anchoring that loop is not as important as anchoring the loop 24 since the side forces of raising are greater at the loop 24.)

This combination bracket has several advantages over prior practices in this field. One of those is the provision of a back plate 32 which has two holes 34, 36 positioned exactly in the same relationship as the holes 44 and 46 of the conventional back plates (FIG. 3). This allows the bracket 30 to be more easily substituted for a conventional bracket and to adapt the system 10 to an existing window and conventional curtain rod arrangement. Only one additional hole 35 is needed for aiding in securing the bracket 30 in place of an existing conventional bracket.

The latch or lock 50 of the bracket 30 may be mechanically conventional and may be, for example, that described in U.S. Pat. No. 4,245,688 or those commercially available under the trademark Shade Track (Model No. 12-1010) made by American Swish. Such a commercially available unit is shown in FIG. 4 captured in the bracket 30.

Figure 5:
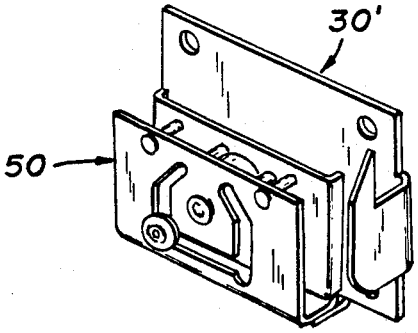
FIG. 5 is a perspective view of a second combination latch and bracket similar to that of FIG. 4, which may be used in place of that unit.
Figure 6:
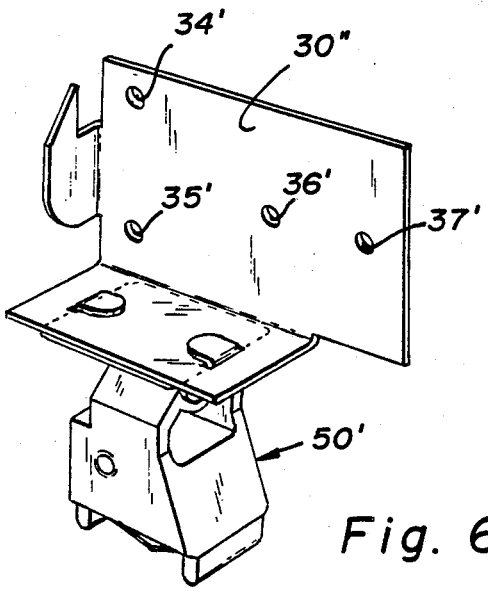
FIG. 6 is a third combination latch and bracket (in this case for the left end of the rod) including a different type of latch or lock, which may be used with the system of FIGS. 1–3.

FIG. 5 shows an alternative embodiment wherein the lock 50 is welded to an abbreviated version of the bracket 30'. FIG. 6 shows a second type of commercially available cord, lock or latch 50' secured to a left side releasable bracket 30''. This version provides four mounting holes 34', 35', 36' and 37', two of which holes (34' and 35') are located in the same position as the conventional curtain rod bracket's holes to allow easy substitution of the new unit in place of a conventional bracket.

As mentioned before, the present invention yields a raisable single rod soft curtain system which is easy to make. Indeed, with a kit as shown in FIG. 7, the average sewing homemaker may construct a soft curtain for use on an existing or purchased conventional single curtain rod using sheet fabric material of the homemaker's choice and employing only conventional sewing methods and normal home tools.

As shown in FIG. 7, a kit 100 for making a soft shade from a fabric sheet and a conventional curtain rod includes at least two and, for the system of FIG. 1, would include five loops 21–25 (each of the loops 21–25 having the main rings secured to them), a length of tape 100 with guide rings 100R (which can be cut into the tapes 16T–19T and form the vertical ring series 16R–19R), a sufficient length of cording 160 to form the pull cords 16–19, the brackets 30 and 40, and fasteners such as nails 130 and, preferably, instructions 140, all packaged together into the kit 100.

The instructions 140 may read as follows:

"Select the material for your soft curtain. Any suitable material may be used so long as it is sized to fit the window you wish to cover. Designer sheets may be used as well as conventional sheets. Sheer fabric can be employed because the finished curtain places very little stress on the fabric since it relies on the loops, ring tapes and pull cords to carry the weight and forces of raising and lowering the finished curtain.

"The fabric sheet should be wide enough to follow the curtain rod and curve back at the sides to the wall. Allow four to six inches extra length for folding and sewing back the top edge to form the pocket for the curtain rod. Fold over the top edge of the fabric four to six inches (as you prefer) and mark and sew along a top line to form the top of the curtain rod pocket. Choose the central two positions for the pull cords and mark them. Place the four loops with their plastic rings facing outward under the overlapping edge as shown in FIG. 3A and sew along 14PB to form the bottom of the curtain rod pocket and to secure the loops in place. Be sure that the tops of the loops are slightly below the top of the pocket, so that the loops will bear the weight of the curtain.

"Cut and sew lengths of tape 100 vertically under the loops making certain that the bottom rings line up horizontally. The curtain is finished.

"Now cut the cord 16 into two equal lengths and feed the four free ends through the outside of the lock 50. Secure the brackets 30 and 50 in place at the window. Put the curtain rod into the curtain and mount it on the brackets. Be sure that the loops are inside the rod and that the end loops are pulled tight against the horn of the brackets which extend out of the rod ends. Feed, one at a time, the four ends of the cord ends through the master ring of each different loop and down through the series of rings - tie it to the bottommost ring so that the cord at the side of the curtain is at a convenient height.

The curtain system is now up and ready to be used."

Note that the loops 21–24 are secured in place by the sewing of the pocket for the curtain rod. No additional steps are needed to secure the loops in place.

The curtain may be easily removed for cleaning or washing by (1) untying the four knots securing the drawstrings to the bottom of the curtain, (2) removing these lines from the rings (and tying a knot in them afterward so that they won't have to be run through the back), and (3) removing the rod from the brackets and sliding the fabric out of the rod. It may be replaced by reversing this process.

It should now be apparent that a novel and easily used kit and system have been described. The kit allows the typical homemaker to sew a sheet of fabric of the homemaker's choice into a raisable soft curtain mounted on a conventional curtain rod. It can be easily installed in place of conventional curtains. Only five wall fasteners such as the nails shown need be used to install the system. The use of the loops eliminates or lessens sideways sliding of the curtain in response to raising normally encountered with single rod raising curtain systems. By using plastic rings and loops, metal parts need not be employed in the fabric curtain itself, which makes it easier to clean or wash. The structure is easily disassembled for cleaning and easily rehung afterward.

While particular embodiments of the invention have been shown and described, it will be obvious to those skilled in the art that changes and modifications may be made without departing from the invention. For example, although the mesh loops are shown presewn at their bottoms and inserted inside the pocket to be "sandwiched" with the fabric of the pocket, the loops may be finished with free ends and sewn outside the pocket. In that case, sewing of the pocket would also sew the loops' ends together. Of course, other changes can be made and, therefore, the aim in the appended claims is to cover all such changes and modifications as fall within the true spirit and scope of the invention.

I claim:

1. A kit for making a raisable soft curtain from a conventional U-shaped curtain rod and a sheet of suitable curtain fabric, the kit comprising:

a plurality of support loops of strong but flexible material and sized so as to freely receive the curtain rod inside the loop and depend below it, each of said loops mounting a main ring such that the main ring may be positioned at or below the curtain rod when the loop is in use, said loops being adapted to be securable to fabric sheet;

a plurality of sets of cord guide rings, one set for each of said loops, each of said sets including a number of rings which may be secured to the fabric in a vertical spaced-apart series under one of said loops;

lengths of cord sufficiently long so as to extend from the bottom of the finished curtain up through said series of guide rings through said main ring and laterally to one edge of the finished curtain and downward therefrom for a sufficient distance to serve as a pull;

a cord releasable lock device for accepting said lengths of cord and means for securing said cord lock device at the upper side of the finished curtain, said kit being for use in combination with rod-receiving brackets of the type having a vertical horn which projects out of a hole in the top of the receiving end of the curtain rod wherein at least one of said support loops has a wide mesh upper surface so that it can be captivated by the horn of the bracket.

2. The kit of claim 1, wherein each of said sets of cord guide rings consists of a length of tape with the rings secured at a spaced array along the tape.

3. The kit of claim 1, wherein said cord lock device is mounted to a curtain rod-receiving bracket so that the combination may be mounted together to a wall.

4. The kit of claim 1, wherein each of said loops is made of plastic mesh wherein each of said sets of cord guide rings consists of a length of tape with the rings secured at a spaced array along the tape, wherein said cord lock device is mounted to a curtain rod and receiving bracket so that the combination may be mounted together to a wall.

5. The method of making a raisable soft curtain to cover a predetermined area from a kit comprising:

a plurality of support loops of strong but flexible material and sized so as to freely receive the curtain rod inside the loop and depend below it, each of said loops mounting a main ring such that the main ring may be positioned at or below the curtain rod when the loop is in use, said loops being adapted to be securable to fabric sheet;

a plurality of sets of cord guide rings, one set for each of said loops, each of said sets including a number of rings which may be secured to the fabric in a vertical spaced-apart series under one of said loops;

lengths of cord sufficiently long so as to extend from the bottom of the finished curtain up through said series of guide rings through said main ring and laterally to one edge of the finished curtain and downward therefrom for a sufficient distance to serve as a pull;

a cord releasable lock device for accepting said lengths of cord and means for securing said cord lock device at the upper side of the finished curtain; and a conventional U-shaped curtain rod comprising the steps of:

providing a sheet of fabric sized to more than cover the desired area, said sheet having a front and back and including an extra top margin area which can be folded back and be sewn horizontally to provide a pocket for the curtain rod;

folding said top margin back while placing the loops in an overlapping sandwiched relationship with the folded fabric, at least the extreme left and right ends of the fold such that the main rings of the loops face backward and are at or below the overlapped marginal area, and sewing the margin horizontally through said loops so as to secure them in place;

securing one of said sets of guide rings to the back of said fabric sheet vertically under each of said loops sewn into the top margin of the sheet;

securing one of said lengths of cord to the bottom of said sheet under each of said loops secured to it for running the cord through guide rings thereabove and through the master ring of said each loop and thence to one side of the curtain;

mounting said cord releasable lock device at that side and passing the cords from each of said master rings through it and down the side to form a pull;

pulling the curtain rod through the pocket and through said loops and hanging the curtain therefrom.

6. A raisable soft curtain assembly comprising:

a conventional U-shaped curtain rod;

a sheet of fabric forming the main body of the curtain, said sheet defining a pocket at its upper margin and receiving said curtain rod therein, said sheet having a front and back side;

a plurality of loops secured to the upper margin, one of said loops being secured at each end of said pocket, said loops being made of strong flexible material and having a portion extending below said pocket;

a plurality of main draw cord rings, one for each of said loops, each of which main ring is secured to said portion of said loop extending below said pocket and the back of said sheet, said loops receiving the curtain rod inside them and serving to transfer weight and forces through said main ring attached thereto, to said rod;

a plurality of sets of guide rings, one set for each of said loops secured to the back of said sheet of fabric in a vertical spaced-apart array;

a plurality of lengths of draw cord, one length for each of said loops, each of said lengths of draw cord having one end secured to the bottom of said sheet under one of said loops with the rest of said lengths running up through said guide rings and through said main ring of said loop and extending laterally to one side of said curtain and downward along that side to form a pull;

a manually releasable cord lock device secured at said one side of said curtain and operationally receiving each of the lengths of cord.

7. The assembly of claim 6 in combination with a rod-receiving bracket holding one end of said rod, said bracket having a vertical horn which projects out of a hole in the top of the received end of said rod and wherein at least one of said support loops has a wide mesh upper surface so that it can be captivated by the horn of the bracket.

8. The assembly of claim 6, wherein each of said sets of cord guide rings consists of a length of tape with the rings secured at a spaced array along the tape.

9. The assembly of claim 6, wherein said cord lock device is mounted to a curtain rod-receiving bracket so that the combination may be mounted together to a wall.

10. The assembly of claim 7, wherein each of said loops is made of plastic mesh wherein each of said sets of cord guide rings consists of a length of tape with the rings secured at a spaced array along the tape, wherein said cord lock device is mounted to a curtain rod and receiving bracket so that the combination may be mounted together to a wall.

11. In combination:

a standard U-shaped curtain rod of the type having two ends, at least one end of said ends having a bracket receiving opening and a small slot defined in its upper surface adjacent the end for receiving a horn projecting from a wall bracket;

a wall bracket which partially enters the hollow end of the curtain rod and has a horn which projects through and above the small slot of the curtain rod;

a raisable soft shade having a tubular fabric pocket formed at one edge and received about said curtain rod;

raising means secured at the other end of said curtain rod, which raising means includes components which during the raising of the curtain exert sideways forces on a portion of the curtain, which forces would, if not resisted, cause that portion of the curtain to travel sideways along said curtain rod; and a loop of tape made of strong wide mesh material, said loop being secured to said soft shade at said tubular fabric pocket at the end of such tubular pocket which overlays said end of the curtain rod and being so secured as to be capable of holding the weight of the shade below it, the mesh being large enough so as to engage said projecting horn such that the mesh tape is drawn down and around said horn by the weight of the shade whereby it prevents said loop from being pulled along said rod away from said wall bracket by the sideways forces exerted during raising of the curtain.

* * * * *